US008448442B2

(12) United States Patent
Slobodyanskiy et al.

(10) Patent No.: US 8,448,442 B2
(45) Date of Patent: May 28, 2013

(54) FLEXIBLE COMBUSTOR FUEL NOZZLE

(75) Inventors: Ilya Aleksandrovich Slobodyanskiy, Greenville, SC (US); Joel Hall, Greenville, SC (US); Jesse Barton, Greenville, SC (US); Vijaykant Sadasivuni, Greenville, SC (US)

(73) Assignee: General Electric Company, Schenectady, NY (US)

( * ) Notice: Subject to any disclaimer, the term of this patent is extended or adjusted under 35 U.S.C. 154(b) by 168 days.

(21) Appl. No.: 13/111,036

(22) Filed: May 19, 2011

(65) Prior Publication Data

US 2012/0291448 A1 Nov. 22, 2012

(51) Int. Cl.
*F02C 1/00* (2006.01)

(52) U.S. Cl.
USPC ..... 60/742; 60/740

(58) Field of Classification Search
USPC ..... 60/775, 39.53, 740, 39.093, 39.463, 60/742, 779; 239/416.4, 416.5, 423, 427.5; 431/181–183, 186, 187, 189; 110/260–264, 110/347
See application file for complete search history.

(56) References Cited

U.S. PATENT DOCUMENTS

| | | | | |
|---|---|---|---|---|
| 5,451,160 | A | 9/1995 | Becker | |
| 7,536,862 | B2 * | 5/2009 | Held et al. | 60/742 |
| 2010/0089020 | A1 | 4/2010 | Barton et al. | |
| 2010/0089021 | A1 | 4/2010 | Barton et al. | |
| 2010/0089022 | A1 | 4/2010 | Barton et al. | |
| 2010/0092896 | A1 * | 4/2010 | Barton et al. | 431/2 |
| 2010/0139238 | A1 | 6/2010 | Hall et al. | |
| 2010/0281876 | A1 | 11/2010 | Khan et al. | |
| 2010/0287937 | A1 * | 11/2010 | Thatcher et al. | 60/740 |

FOREIGN PATENT DOCUMENTS

EP 1391657 A2 2/2004

OTHER PUBLICATIONS

Search Report and Written Opinion from EP Application No. 12168243.9 dated Sep. 20, 2012.

* cited by examiner

*Primary Examiner* — Phutthiwat Wongwian
*Assistant Examiner* — Vikansha Dwivedi
(74) *Attorney, Agent, or Firm* — Sutherland Asbill & Brennan LLP

(57) ABSTRACT

The present application provides a flexible combustor fuel nozzle. The flexible combustor fuel nozzle may include a main passage in communication with a source of natural gas and a source of low BTU fuel, a secondary passage surrounding the main passage and in communication with the source of low BTU fuel and a source of purge air, and a tertiary passage surrounding the secondary passage and in communication with the source of low BTU fuel, the source of purge air, and a source of diluent.

19 Claims, 2 Drawing Sheets

FLEXIBLE COMBUSTOR FUEL NOZZLE

TECHNICAL FIELD

The present application relates generally to gas turbine engines and more particularly relates to a fuel flexible combustor fuel nozzle for use with ultra low to medium BTU fuel applications as well as other types of fuels and/or combinations of fuels.

BACKGROUND OF THE INVENTION

Modern gas turbine engines may offer fuel flexibility in that both natural gas and highly reactive fuels such as syngas and the like may be used. The use of a diverse fuel spectrum provides increased operational flexibility, cost control, plant efficiency, and/or improved emissions characteristics. Such fuel flexibility provides customers with the ability to select a fuel source based upon availability, price, and other variables.

The combustor of the gas turbine engine, however, must be able to accommodate the significant differences between the characteristics of natural gas and syngas such as in Wobbe number and fuel reactivity. For example, the volumetric flow rate for syngas may be more than double the volumetric flow rate for natural gas for the same combustion temperature. As such, the syngas fuel pressure ratios may be extremely high. Moreover, the use of such highly reactive fuels may lead to flame holding and possible nozzle damage.

There is a desire for improved combustor fuel nozzle designs that provide fuel flexibility to accommodate a variety of fuels. The combustor fuel nozzle should be able to accommodate both natural gas and syngas without limiting durability or efficiency. The combustor fuel nozzle preferably provides syngas combustion with comparable performance to natural gas combustion in terms of flow, mixing, dynamics, and emission patterns.

SUMMARY OF THE INVENTION

The present application and the resultant patent thus provide a flexible combustor fuel nozzle. The flexible combustor fuel nozzle may include a main passage in communication with a source of natural gas and a source of low BTU fuel, a secondary passage surrounding the main passage and in communication with the source of low BTU fuel and a source of purge air, and a tertiary passage surrounding the secondary passage and in communication with the source of low BTU fuel, the source of purge air, and a source of diluent.

The present application and the resultant patent further provide a method of operating a combustor fuel nozzle. The method includes the steps of flowing a natural gas or a low BTU fuel from a main passage, flowing the low BTU fuel or a purge air flow from a secondary passage, and flowing the low BTU fuel, the purge air flow, or a diluent flow from a tertiary passage.

The present application and the resultant patent further provide a flexible combustor fuel nozzle. The fuel flexible combustor fuel nozzle may include a main passage in communication with a source of natural gas and a source of low BTU fuel, one or more secondary passages surrounding the main passage and in communication with the source of low BTU fuel, a source of purge air, and/or a source of nitrogen, and a tertiary passage surrounding the secondary passages and in communication with the source of low BTU fuel, the source of purge air, the source of nitrogen, and a source of diluent.

These and other features of the present application and the resultant patent will become apparent to one of ordinary skill in the art upon review of the following detailed description when taken in conjunction with the several drawings and the appended claims.

DETAILED DESCRIPTION

Figure 1:
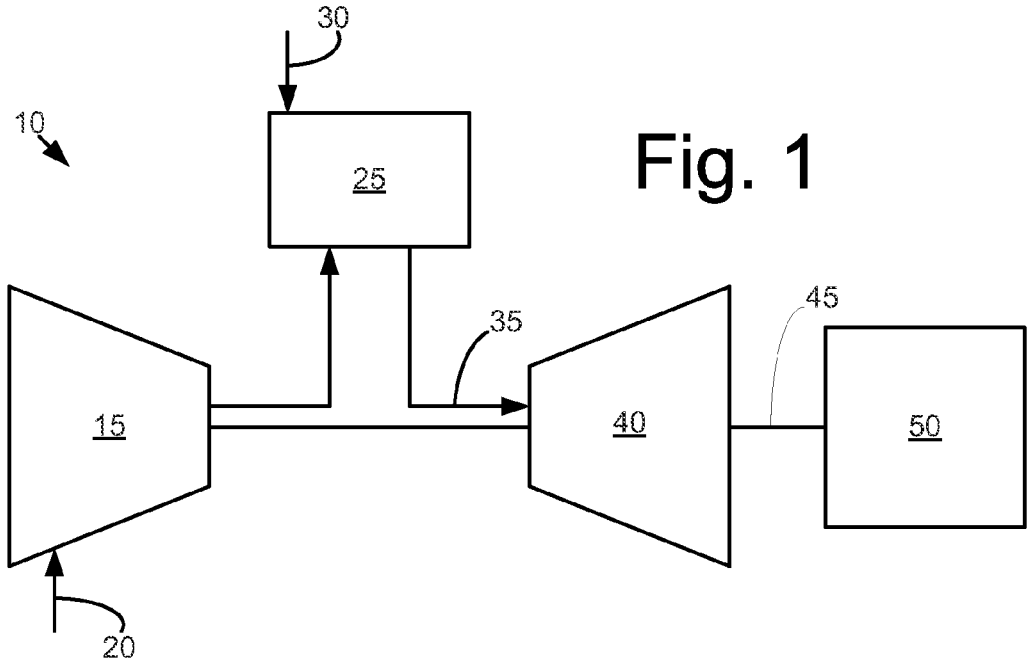
FIG. 1 is a schematic view of a gas turbine engine.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a compressed flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 so as to produce mechanical work. The mechanical work produced in the turbine 40 drives the compressor 15 via a shaft 45 and an external load 50 such as an electrical generator and the like. Other components and other configurations may be used herein.

The gas turbine engine 10 may use natural gas, various types of syngas, and/or other types of fuels. The gas turbine engine 10 may be any one of a number of different gas turbine engines, including but not limited to, those offered by General Electric Company of Schenectady, N.Y. and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
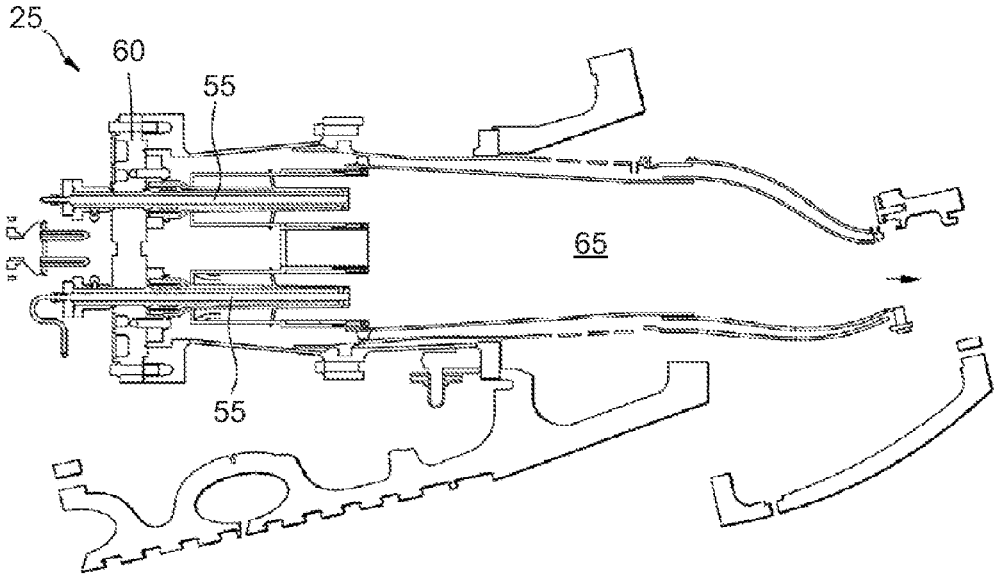
FIG. 2 is a side cross-sectional view of a combustor of the gas turbine engine.

FIG. 2 shows an example of the combustor 25. As is shown, the combustor 25 includes a number of fuel nozzles 55. Any number of the fuel nozzles 55 may be used herein. The fuel nozzles 55 may be positioned within an endcover 60 or other type of support structure. As described above, the fuel nozzles 55 ignite the flow of air 20 and the flow of fuel 30 to create the flow of combustion gases 35 within a combustion zone 65 for use in driving the turbine 40. Other components and other configurations may be used herein.

Figure 3:
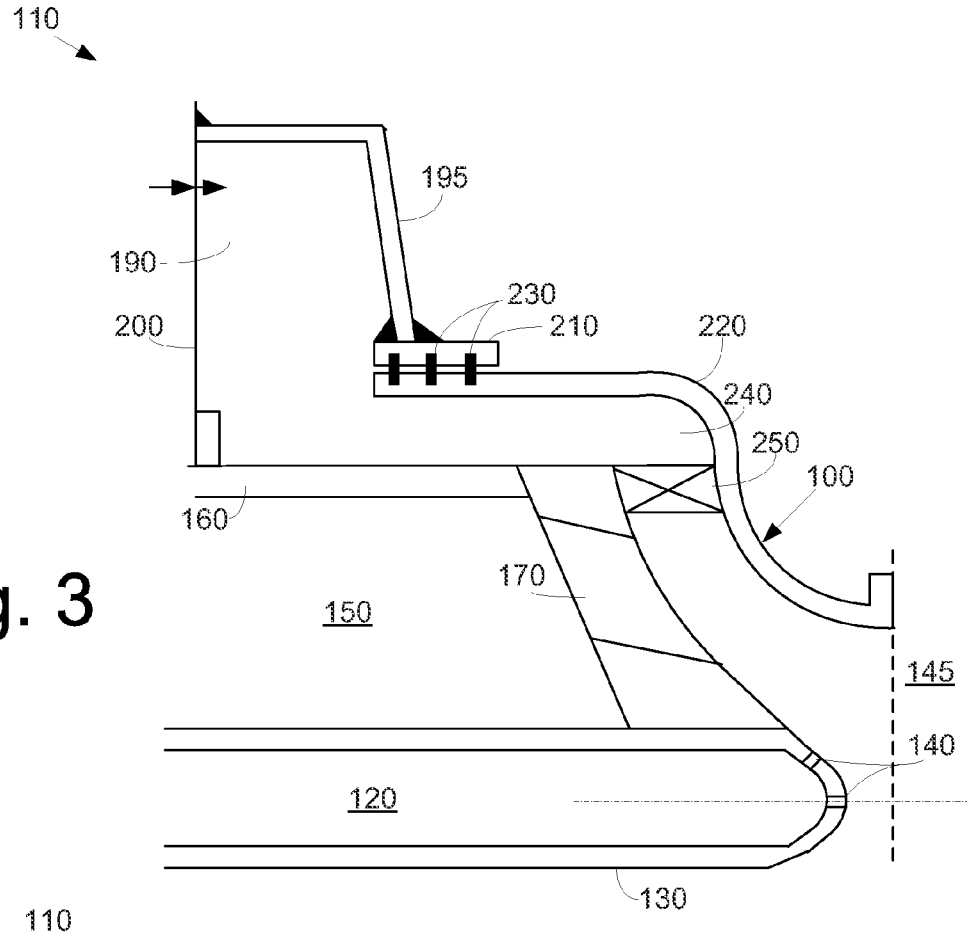
FIG. 3 is a side cross-sectional view of a portion of a fuel nozzle as may be described herein.

FIG. 3 shows a portion of a fuel nozzle 100 as may be described herein. The fuel nozzle 100 may be used in a combustor 110 such as the combustor 25 described above. Any number of the fuel nozzles 100 may be used within the combustor 110. Fuel nozzles of differing configurations may be used herein.

The fuel nozzle 100 may include a pilot or main passage 120. The main passage 120 may be an elongated tube 130 with one or more injection holes 140 thereon at a downstream end 145 thereof. The injection holes 140 may have differing configurations and locations. The main passage may flow natural gas, liquid fuels, or syngas. Different types of fuels may be used at different times and/or under different operating conditions. Other types of fuels, other components, and other configurations may be used herein.

Surrounding the main passage 120 may be one or more secondary passages 150. The secondary passages 150 also may be elongated tubes 160 with one or more injection holes 170 at the downstream end 145 thereof. The injection holes 170 may have differing configurations and locations. The secondary passages 150 may provide a flow of purge air, a flow of an inert purge such as nitrogen, or a flow of a low BTU fuel such as a syngas depending upon the mode of operation. Different types of fluid flows may be used at different times and/or under different operating conditions. Other types of fluid flows, other components, and other configurations may be used herein.

The fuel nozzle 100 also may include an inert or a tertiary passage 180. The tertiary passage 180 may surround the secondary passage 150. The tertiary passage 180 may include an air plenum 190. The air plenum 190 may be defined between a baffle plate 195 and a cover-ring 200 or otherwise. The baffle plate 195 may terminate about a shroud 210. The shroud 210 may be separated from a nozzle collar 220 and the like by a number of piston rings 230. Any number of piston rings 230 may be used herein. The shroud 210 and/or the nozzle collar 220 may define a flow channel 240 therein in communication with the air plenum 190 on one end and one or more flow holes 250 on another. The tertiary passage 180 may provide a flow of inert diluent, a flow of purge air, a flow of an inert purge such as nitrogen, or a flow of a low BTU fuel such as a syngas. Different types of fluid flows may be used at different times and/or under different operating conditions. Other types of fluid flows, other components, and other configurations may be used herein.

Figure 4:
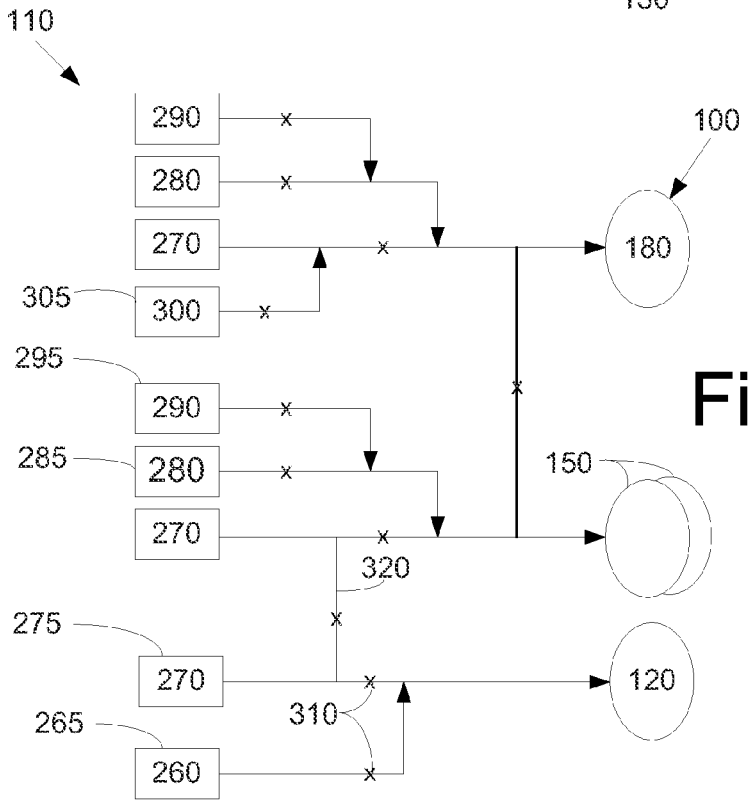
FIG. 4 is a schematic of a combustor fuel scheme using the fuel nozzle of FIG. 3.

FIG. 4 shows a fueling scheme for the fuel nozzle 100 of the combustor 110. As is shown, the main passage 120 may be in communication with a natural gas source 260 with a flow of natural gas 265 therein and a low BTU fuel source 270 with a flow of low BTU fuel 275 therein. A liquid fuel source also may be used herein. The secondary passages 150 may be in communication with the low BTU fuel source 270, a purge air source 280 with a flow of purge air 285 therein, and a nitrogen purge source 290 with a flow of nitrogen 295 therein. The tertiary passage 180 may be in communication with the low BTU fuel source 270, the purge air source 280, the nitrogen purge source 290, and a diluent source 300 with a flow of diluent 305 therein. Various types of control valves 310 and by-pass lines 320 also may be used herein. Other types of flows, other components, and other configurations also may be used herein. Although, for example, multiple low BTU fuel sources 270 are shown in the drawings, it will be understood that a single source or multiple sources may be used for each of the fluid flow described herein.

The low BTU fuel source is intended to mean a fuel that has lower calorific value than conventional gaseous, liquid, or solid fuels (e.g., methane) but which has a calorific value that is high enough to create a combustible mixture and allow continuous burning. Low BTU fuels may be characterized as having a calorific range between 90 and 700 BTU/scf (British thermal units per standard cubic feet). The calorific value is a fuel property that defines the amount of heat released when burned. Low BTU fuels may have a higher concentration of constituents with no or low calorific value (e.g., carbon monoxide, carbon dioxide, nitrogen, and so forth). Other types of fuel ranges may be used herein.

The fuel nozzle 100 thus may have many different modes of operation. For example, in an unabated natural gas mode, natural gas may be provided to the main passage 120 and purge air may be provided to the secondary passage 150 and tertiary passage 180. In an abated mode, natural gas may be provided to the main passage 120, purge air may be provided to the secondary passage 150, and diluent may be provided to the tertiary passage 180. Liquid fuel operations also may be used herein.

In an abated transfer mode from natural gas or liquid fuel to syngas, many different options may be used herein. In a first option, natural gas may be supplied to the main passage 120, purge air may be provided to the secondary passage 150, and the low BTU fuel may be provided to the tertiary passages 180. In a second option, the low BTU fuel may be provided to the main passage 120, purge air may be provided to the secondary passage 150, and the low BTU fuel may be provided to the tertiary passage 180. In a third option, the low BTU fuel may be provided to the main passage 120, nitrogen may be provided to the secondary passage, and the low BTU fuel may be provided to the tertiary passage 180. In a fourth option, the low BTU fuel may be provided to the main passage, the secondary passage, and the tertiary passage 180. Other options may be used herein.

In an unabated transfer mode, several different options also may be used. In a first option, natural gas may be provided to the main passage 120, purge air may be provided to the secondary passage 150, and nitrogen may be provided to the tertiary passage 180. In a second option, natural gas may be provided to the main passage 120, purge air may be provided to the secondary passages 150, and the low BTU fuel may be provided to the tertiary passage 180. In a third option, natural gas may be provided to the main passage 120, nitrogen may be provided to the secondary passage 150, and the low BTU fuel may be provided to the tertiary passage 180. In a fourth option, natural gas may be provided to the main passage 120 while the low BTU fuel may be provided to the secondary passage 150 and the tertiary passage 180. In a fifth option, the low BTU fuel may be provided to the main passage 120, the secondary passage 150, and the tertiary passage 180. Other options also may be used herein.

Other modes of operation include diluent injection for suppression of nitrogen oxides with natural gas, liquid fuel, medium BTU fuels, low BTU fuels, and ultra low BTU fuels. Further, a number of co-fire modes also may be used herein. Other modes of operation and combinations thereof may be used herein.

The fuel nozzle 100 thus may control combustion dynamics by varying the pressure ratios in the secondary passage 150 and the tertiary passage 180 when operating on low BTU fuels, including ultra low BTU fuel. The fuel nozzle 100 requires less inert purge flow (nitrogen so as to help dynamics abatement during mode transfer. The fuel nozzle 100 also may lower the risk of flame holding by active control of the flows at the downstream end 145 and within the combustion zone 65. The fuel nozzle 100 also allows turndown extensions with the use of the low and the ultra low BTU fuels and the like.

Different types of combustors 100 may be used herein. For example, can, can annular, or annular types of combustion systems may be used herein. Liquid fuel, natural gas, medium BTU fuels, low BTU fuels, and ultra low BTU fuels, or any combination thereof may be used herein.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A flexible combustor fuel nozzle, comprising:

a main passage;

the main passage in communication with a source of natural gas and a source of low BTU fuel;

a secondary passage surrounding the main passage;

the secondary passage in communication with the source of low BTU fuel and a source of purge air; and a tertiary passage surrounding the secondary passage;

the tertiary passage in communication with the source of low BTU fuel, the source of purge air, and a source of diluent.

2. The flexible combustor fuel nozzle of claim 1, wherein the main passage comprises an elongated tube and one or more injection holes at a downstream end thereof.

3. The flexible combustor fuel nozzle of claim 1, wherein the secondary passage comprises an elongated tube and one or more injection holes at a downstream end thereof.

4. The flexible combustor fuel nozzle of claim 1, further comprising a plurality of secondary nozzles.

5. The flexible combustor fuel nozzle of claim 1, wherein the tertiary passage comprises a shroud and a plurality of piston rings.

6. The flexible combustor fuel nozzle of claim 1, wherein the tertiary passage comprises an air plenum therein.

7. The flexible combustor fuel nozzle of claim 6, wherein the tertiary passage comprises a flow channel extending from the air plenum to one or more flow holes.

8. The flexible combustor fuel nozzle of claim 1, further comprising a source of nitrogen in communication with the secondary passage and the tertiary passage.

9. The flexible combustor fuel nozzle of claim 1, wherein the main passage comprises a flow of natural gas or a flow of low BTU fuel therein.

10. The flexible combustor fuel nozzle of claim 1, wherein the secondary passage comprises a flow of low BTU fuel or a flow of purge air therein.

11. The flexible combustor fuel nozzle of claim 1, wherein the tertiary passage comprises a flow of low BTU fuel, a flow of purge air, or a flow of diluent therein.

12. The flexible combustor fuel nozzle of claim 1, further comprising a by-pass line positioned between the main passage and the secondary passage and/or between the secondary passage and the tertiary passage.

13. The flexible combustor fuel nozzle of claim 1, further comprising one or more control valves positioned on the main passage, the secondary passage, and/or the tertiary passage.

14. The flexible combustor fuel nozzle of claim 1, further comprising a nozzle collar at a downstream end thereof.

15. A flexible combustor fuel nozzle, comprising:

a main passage;

the main passage in communication with a source of natural gas and a source of low BTU fuel;

one or more secondary passages surrounding the main passage;

the one or more secondary passages in communication with the source of low BTU fuel, a source of purge air, and/or a source of nitrogen; and a tertiary passage surrounding the one or more secondary passages;

the tertiary passage in communication with the source of low BTU fuel, the source of purge air, the source of nitrogen, and a source of diluent.

16. The flexible combustor fuel nozzle of claim 15, wherein the tertiary passage comprises a shroud and a plurality of piston rings.

17. The flexible combustor fuel nozzle of claim 15, wherein the tertiary passage comprises an air plenum therein.

18. The flexible combustor fuel nozzle of claim 17, wherein the tertiary passage comprises a flow channel extending from the air plenum to one or more flow holes.

19. The flexible combustor fuel nozzle of claim 15, further comprising a nozzle collar at a downstream end thereof.

* * * * *